US010246863B2

(12) United States Patent
Xie et al.

(10) Patent No.: US 10,246,863 B2
(45) Date of Patent: Apr. 2, 2019

(54) DRAIN VALVE FOR LOW-LEVEL WATER TANK FLUSHING

(71) Applicant: XIAMEN AXENT CORPORATION LIMITED, Xiamen (CN)

(72) Inventors: Wenqing Xie, Xiamen (CN); Fusheng Li, Xiamen (CN)

(73) Assignee: XIAMEN AXENT CORPORATION LIMITED, Xiamen (CN)

( * ) Notice: Subject to any disclaimer, the term of this patent is extended or adjusted under 35 U.S.C. 154(b) by 40 days.

(21) Appl. No.: 15/543,926

(22) PCT Filed: Jan. 18, 2016

(86) PCT No.: PCT/CN2016/071158
§ 371 (c)(1),
(2) Date: Jul. 14, 2017

(87) PCT Pub. No.: WO2016/116016
PCT Pub. Date: Jul. 28, 2016

(65) Prior Publication Data

US 2018/0016777 A1 Jan. 18, 2018

(30) Foreign Application Priority Data

Jan. 21, 2015 (CN) ..... 2015 1 0027736

(51) Int. Cl.

| | |
|---|---|
| ***E03D 1/35*** | (2006.01) |
| ***E03D 1/36*** | (2006.01) |
| ***E03D 5/092*** | (2006.01) |
| ***E03D 1/30*** | (2006.01) |
| *E03D 1/26* | (2006.01) |
| *E03D 1/33* | (2006.01) |

(52) U.S. Cl.
CPC ..... *E03D 1/35* (2013.01); *E03D 1/306* (2013.01); *E03D 1/36* (2013.01); *E03D 5/092* (2013.01); *E03D 1/266* (2013.01); *E03D 1/33* (2013.01)

(58) Field of Classification Search
CPC ..... E03D 1/35; E03D 5/00
USPC ..... 4/366
See application file for complete search history.

(56) References Cited

U.S. PATENT DOCUMENTS 5,175,894 A 1/1993 Chen
5,579,542 A 12/1996 Hayman
(Continued)

FOREIGN PATENT DOCUMENTS

CN 1075998 A 9/1993
CN 1322268 A 11/2001
(Continued)

OTHER PUBLICATIONS

International Search Report for PCT/CN2016/071158 dated Apr. 28, 2016; 10 pages including English translation.

*Primary Examiner* — Christine Skubinna
(74) *Attorney, Agent, or Firm* — Schwabe Williamson & Wyatt, PC

(57) ABSTRACT

A drain valve for low-level water tank flushing includes a drain valve body, a low-level washing ring flushing device and a switch assembly. The switch assembly includes a switch element and a switch sheet. The switch element is connected to the switch sheet by using a lifting rod. When the switch element opens a sealing assembly of the drain valve body under the action of an external force, the switch sheet changes a channel between a water inlet and a water outlet from a small opening state to a big opening state.

20 Claims, 13 Drawing Sheets

(56) References Cited

U.S. PATENT DOCUMENTS

| | | | |
|---|---|---|---|
| 6,502,251 | B1 | 1/2003 | Teshima |
| 2013/0111658 | A1 | 5/2013 | Song |

FOREIGN PATENT DOCUMENTS

| | | | |
|---|---|---|---|
| CN | 1693604 | A | 11/2005 |
| CN | 101545278 | A | 9/2009 |
| CN | 103104015 | A | 5/2013 |
| CN | 103122653 | A | 5/2013 |
| CN | 203891162 | U | 10/2014 |
| CN | 204081009 | U | 1/2015 |
| CN | 104912163 | A | 9/2015 |
| JP | 4122830 | B2 | 7/2008 |
| KR | 101261513 | B1 | 5/2013 |

DRAIN VALVE FOR LOW-LEVEL WATER TANK FLUSHING

CROSS-REFERENCE TO RELATED APPLICATION

This application is a National Phase entry of PCT Application No. PCT/CN2016/071158, filed Jan. 18, 2016, which claims the benefit of priority to Chinese Patent Application No. 201510027736.2, titled "DRAIN VALVE FOR LOW-LEVEL WATER TANK FLUSHING", filed with the Chinese State Intellectual Property Office on Jan. 21, 2015, the entire disclosures of which are incorporated herein by reference.

FIELD

This application relates to a drain valve for low-level water tank flushing, and particularly to a drain valve for low-level water tank flushing which synchronously opens or closes a switch sheet of a low-level flushing device and a switch member of a drain valve body.

BACKGROUND

In a toilet with a low-level water tank, the water tank is generally arranged in a position slightly lower than a seat ring at the rear of the toilet. In the case that the water tank is positioned at the bottom of the water tank and a water level of the water tank is lower than an upper edge of a washing ring, the flushing of the washing ring obviously can not be achieved by conventional gravity drainage. The solution in the conventional technology is that a low-level washing ring flushing device employing the negative pressure principle draws water in the water tank to the washing ring at a higher level by means of a water inlet pressure of tap water, so as to achieve the washing ring flushing.

Technical Issue

In the conventional technology, a low-level washing ring flushing device employing the negative pressure principle is generally connected to a water inlet valve in a water tank, and the water inlet valve is controlled to be opened or closed by a float with the aid of water level of the water tank. The float is connected to a switch of the low-level washing ring flushing device by a conversion device. In the case that the float is arranged through a guide device, the float is apt to be stuck in the guide device, causing failure of the switch of the low-level washing ring flushing device.

In order to address this issue, an individual float pulling device is provided to assist in the opening and closing of the low-level washing ring flushing device in some solutions. Those solutions, though addressing the issue of the switch failure, cause too many members in the water tank, resulting difficulties in installation and maintenance.

Thus, in some solutions, the low-level washing ring flushing device is improved, that is, the low-level washing ring flushing device is fixedly connected to the inlet water valve, and the float which controls the opening and closing of the water inlet valve controls the opening and closing of both the water inlet valve and the low-level washing ring flushing device through a conversion or connection device. The float device of the water inlet valve is generally arranged at a position where the water level is high, however, the low-level washing ring flushing device is required to be arranged at a position of the water tank as low as possible in order to achieve the flushing effect, and thus the overall volume of the water inlet valve along with the low-level washing ring flushing device is larger, which occupies a large space in the water tank.

Solution to the Issues

Technical Solution

A drain valve for low-level water tank flushing is provided according to the present application, which has a simple structure, can be opened or closed conveniently and has a good flushing effect.

The drain valve for low-level water tank flushing includes a drain valve body, a low-level washing ring flushing device and a switch assembly. The drain valve body includes a sealing assembly and a valve seat. The sealing assembly is arranged on the valve seat and configured to open or close a drain port of the valve seat. The low-level washing ring flushing device includes a water inlet and a water outlet. The water inlet is in communication with an outlet of a water inlet valve in a water tank. The switch assembly includes a switch member which controls the movement orf the sealing assembly and opens or closes the drain port by controlling the movement of the sealing assembly, and a switch sheet which is configured to switch between different communication states of the water inlet and the water outlet. The switch member is connected to the switch sheet by a connection member. When the switch member opens the sealing assembly under the action of an external force, the switch sheet is moved to allow a channel between the water inlet and the water outlet to switch from a small opening state to a large opening state simultaneously.

An opening portion in communication with the water tank is provided between the water inlet and the water outlet. The switch member is connected to the switch sheet by the connection member. By means of the connection member, the switch member opens the sealing assembly under the action of an external force for draining. The water level falls and thus allows the water inlet valve in the water tank to be opened and feed water, meanwhile, the switch sheet is moved to allow the channel between the water inlet and the water outlet to switch from the small opening state to the large opening state. Then, the water from the outlet of the water inlet valve flows into the water inlet, and a negative pressure is generated when the water passes through the opening portion provided between the water inlet and the water outlet. With the negative pressure, the water in the water tank is drawn towards the water outlet. The amount of water exiting the water outlet is at least twice the amount of water entering the water inlet; when the draining ends, the sealing assembly closes the drain port, and meanwhile, the switch sheet allows the channel to restore into the small opening state.

The opening of the sealing assembly causes the displacing of the switch sheet. The sealing assembly is normally arranged at the bottom of the water tank, and the low-level washing ring flushing device is also normally arranged at the bottom of the water tank in order to achieve a better flushing effect. Therefore, the opening of the sealing assembly and the low-level washing ring flushing device does not require a long connection device, and the low-level washing ring flushing device does not need to be actuated to open by a float, and thus the structure of the drain valve for low-level water tank flushing is compact.

Preferably, the connection member is a lifting rod. A conversion device includes a crank and a connection bar. The swing of the lifting rod drives the connection bar to rotate, and the connection bar drives the crank to rotate during rotation, so that the switch sheet movably connected to the crank is moved or restored. The lifting rod moves the switch sheet while lifting up the sealing assembly. The displacing of the switch sheet is achieved completely by force conversion of a mechanical structure. The connection of the mechanical structures is stable and not apt to fail, which makes the flushing performance of the toilet stable.

Preferably, the drain valve body is a float-type drain device. One end, connected to the switch sheet by the conversion device, of the lifting rod is a sealing assembly drive end, and another end, connected to the sealing assembly, of the lifting rod is a switch sheet drive end. The lifting rod is rotatably connected to the sealing assembly. The drain valve body also includes a float. The float and the sealing assembly can be actuated by each other. The drain valve body also includes a housing on which a fulcrum shaft for fixing the lifting rod is provided. The lifting rod is movably connected to an upper-middle portion of the fulcrum shaft and is swung by taking the fulcrum shaft as a fulcrum point. The lifting rod can make a lever-motion taking the fulcrum shaft as a fulcrum point. When the sealing assembly drive end of the lifting rod is lifted upwards, the sealing assembly opens the drain port, and meanwhile, the switch sheet drive end of lifting rod is moved downwardly, and a downwardly driving force drives the switch sheet to be in a moved state through the conversion device.

In the case that the switch member is a flexible wire, the flexible wire is connected to the sealing assembly or the sealing assembly drive end of the lifting rod. The sealing assembly or the sealing assembly drive end is pulled by an external force via the flexible wire, the sealing assembly opens the drain port and the sealing assembly drive end of the lifting rod is moved upwardly, which allows the switch sheet drive end of the lifting rod to drive the connection bar to further drive the crank and thus move the switch sheet.

In the case that the switch member is a button, the switch sheet drive end of the lifting rod is located below the button. The button is driven by an external force to drive the switch sheet drive end to move downwardly, so as to drive the switch sheet to be moved, and meanwhile, the sealing assembly drive end of the lifting rod is moved upwardly to drive the sealing assembly to open the drain port.

The switch device may be embodied as both the flexible wire and the button described above, and one or both of them may be used as actually required.

Preferably, in the case that the drain valve body is a float-type drain device, a vertical slide rod is provided in the housing and the vertical slide rod is provided with a guide slide groove. The sealing assembly is slidably secured to the slide rod via the guide slide groove. One end of the lifting rod is movably connected to the sealing assembly.

In the case that the drain valve body is a flapper-type drain device, the sealing assembly is a flapper device. One end of the flapper device is movably secured to the valve seat, and the drain port of the valve seat is sealed by a lid body of the flapper. When the flapper device is pulled up, the flapper opens the drain port. At the same time, the flapper device is pivoted upon the fixed fulcrum point, and the lifting rod engaged with the sealing assembly is driven to move the switch sheet under the action of the conversion device.

Preferably, the flapper device is engaged with the lifting rod in a same direction to form a lever, which can make a lever-motion upon the fixed fulcrum point on the valve seat. When the flapper device is pulled up in a counterclockwise direction, the lifting rod is moved downwardly in the counterclockwise direction to drive the switch sheet to be moved.

Preferably, the flapper device is engaged with the lifting rod in a reverse direction. When the flapper device is lifted up in the counterclockwise direction, the one end of the flapper device secured to the valve seat pushes the lifting rod to move upwardly in a clockwise direction so as to move the switch sheet.

Preferably, the low-level washing ring flushing device is integrally formed with the drain valve body, or is detachably secured on the drain valve body by a snap-fitting rib.

Beneficical Effects of the Application

Beneficical Effects

The present application has the following beneficial effects:

1. The switch sheet of the low-level washing ring flushing device and the switch member of the drain valve body are actuated simultaneously. In the case that the drain valve body is driven and opened, the switch sheet of the low-level water tank flushing device is synchronously driven to allow the channel to switch into the large opening state under the action of the conversion device. The conversion device for driving the opening is the mechanical structure, thus the product has a stable performance and a long service life.

2. The low-level washing ring flushing device does not require an additional switch device, so that the structure is more compact;

3. The low-level washing ring flushing device is integrally formed with the drain valve body or is removably secured by a snap-fitting rib for facilitating installation and maintenance;

4. The switch sheet of the low-level washing ring flushing device is simultaneously switched to be moved when the drain valve body is driven to be opened, which does not require an additional switch device, saving the cost.

BRIEF DESCRIPTION OF THE DRAWINGS

Description of the Drawings

Figure 1:
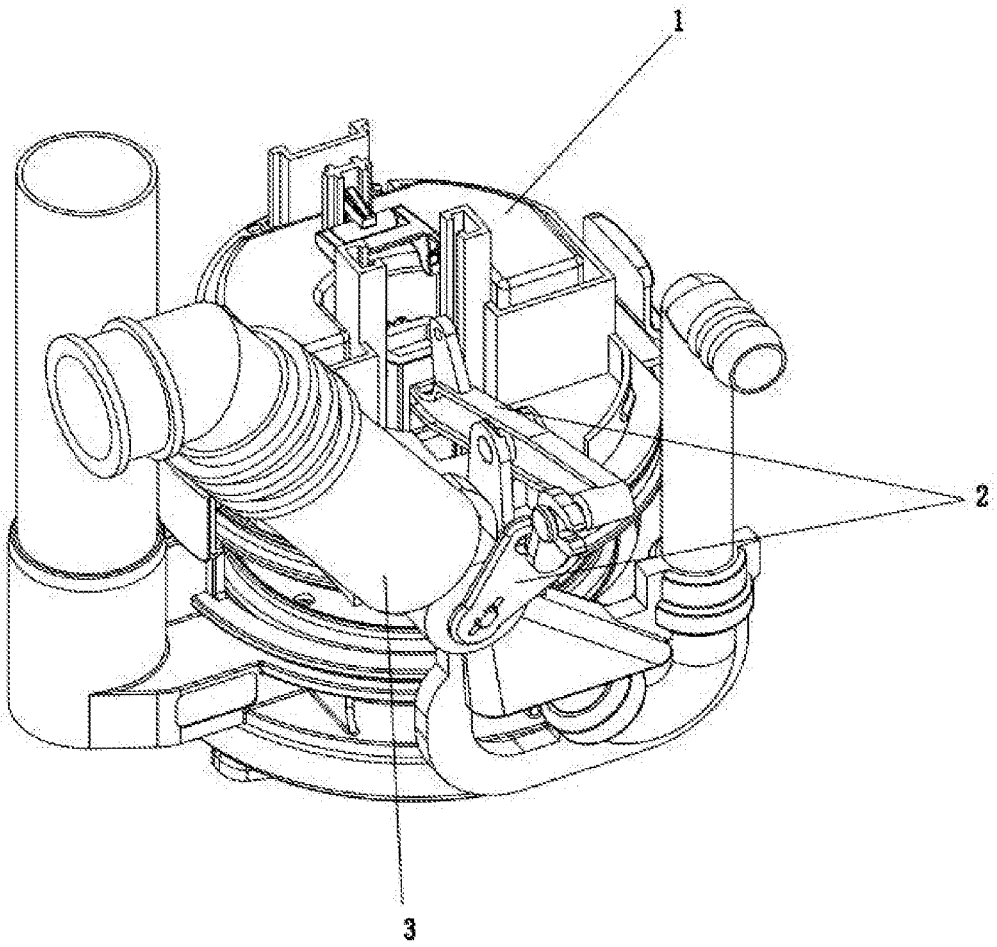
Figure 2:
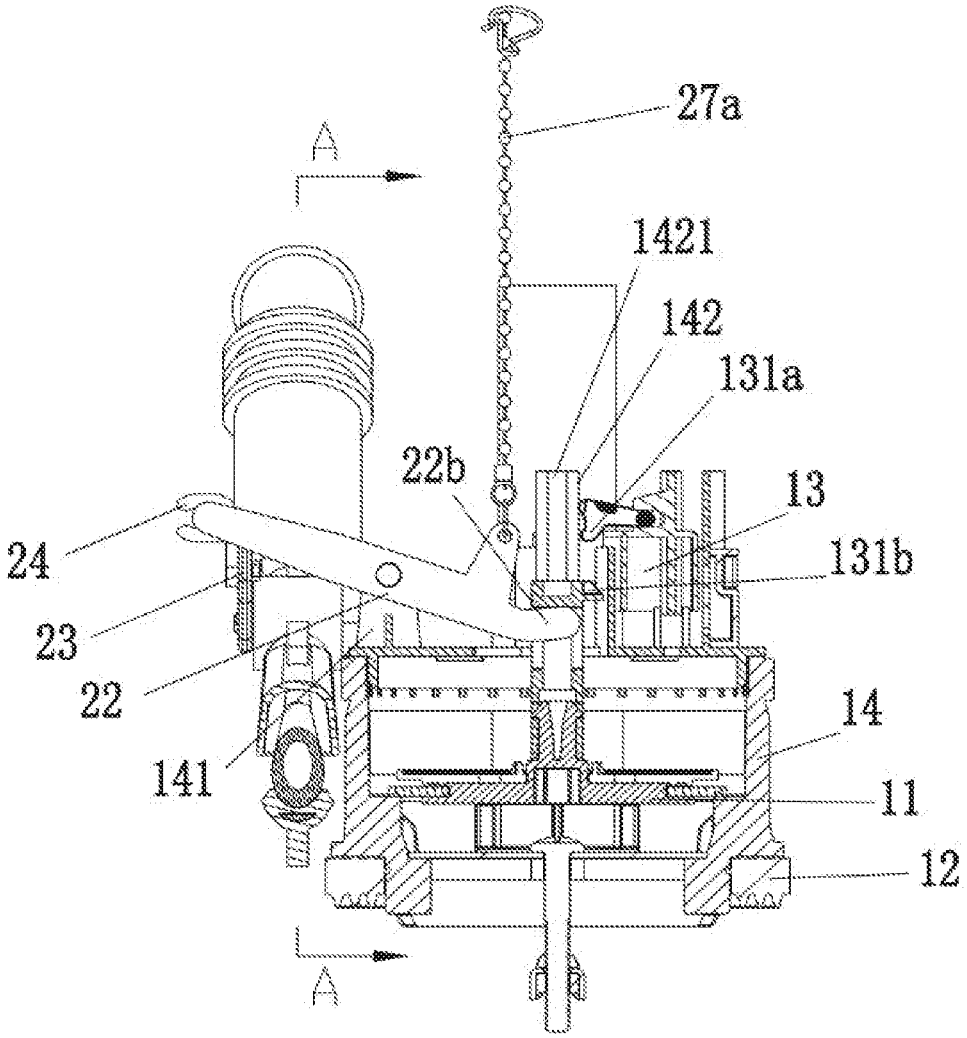
Figure 3:
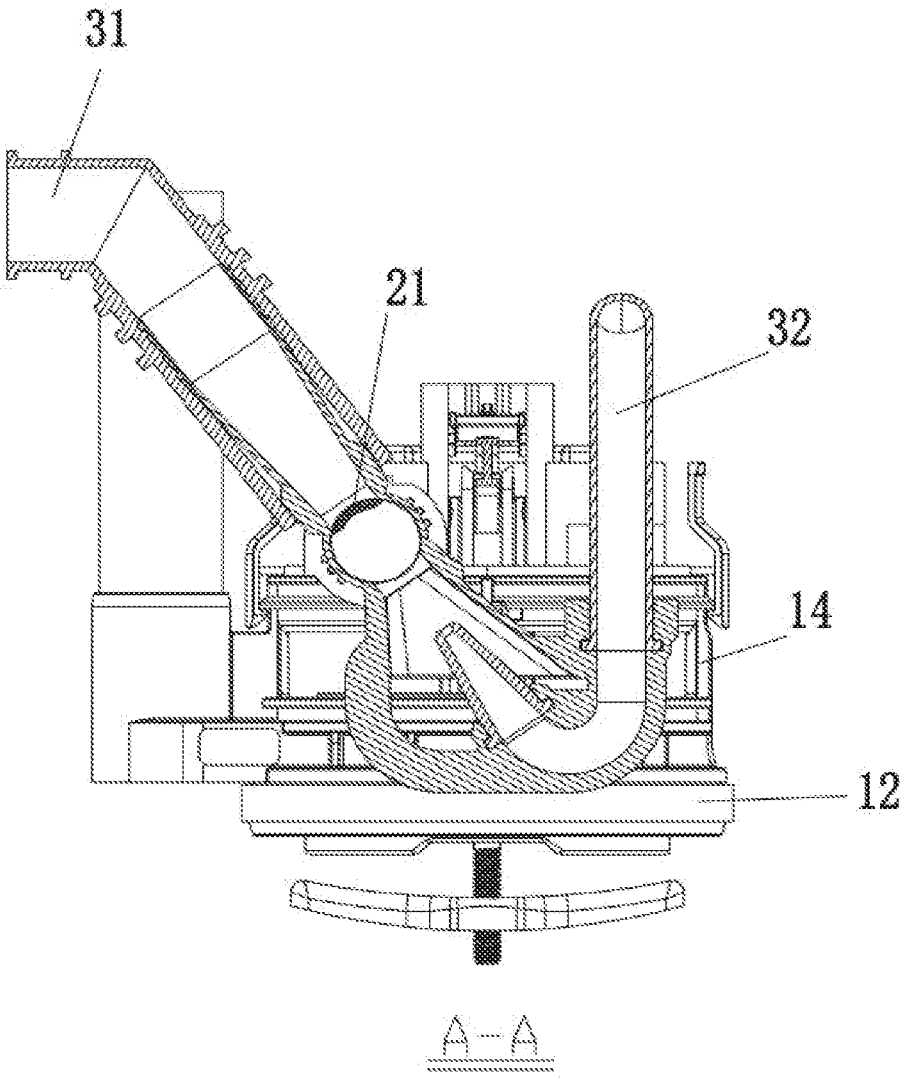
Figure 4:
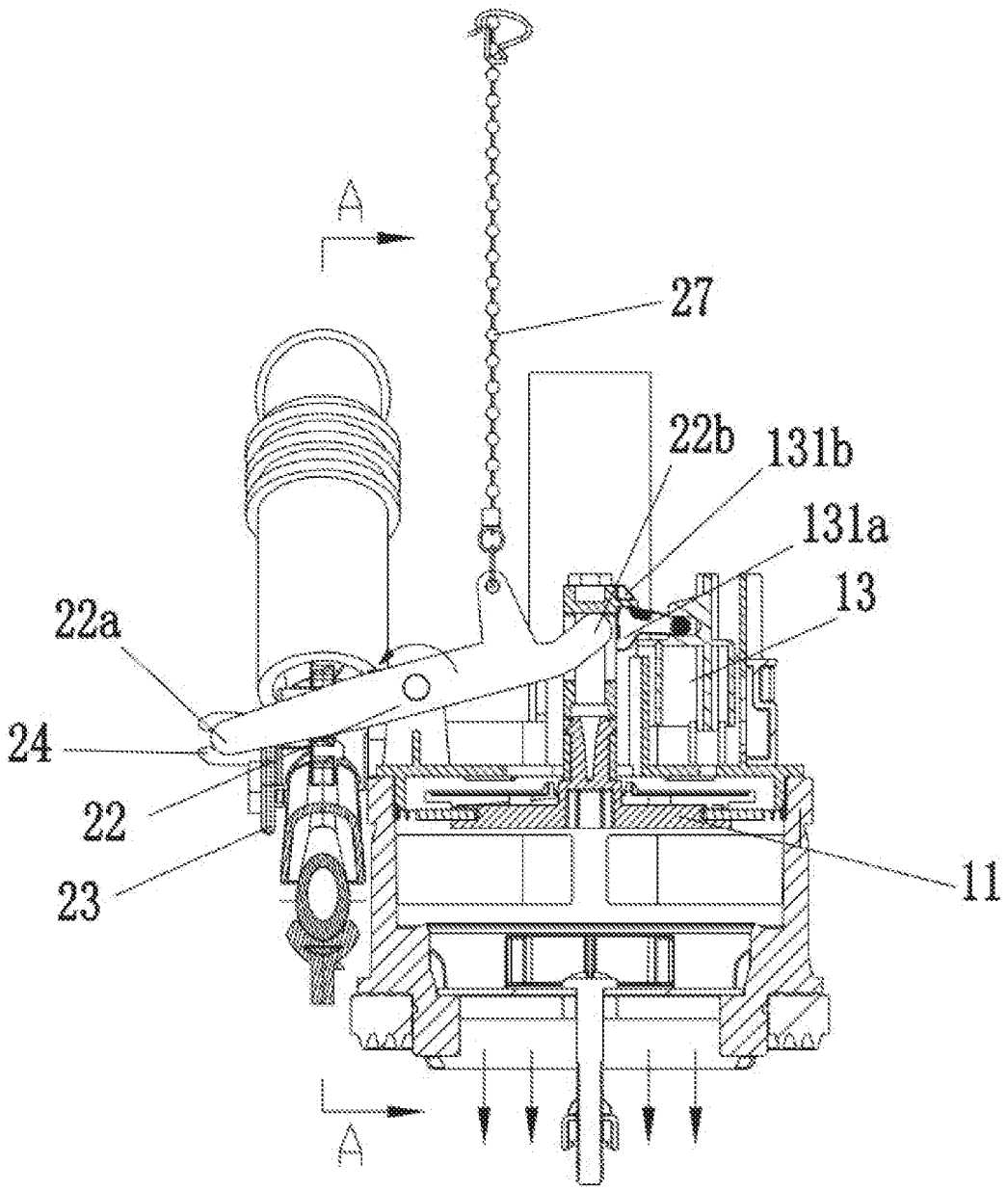
Figure 5:
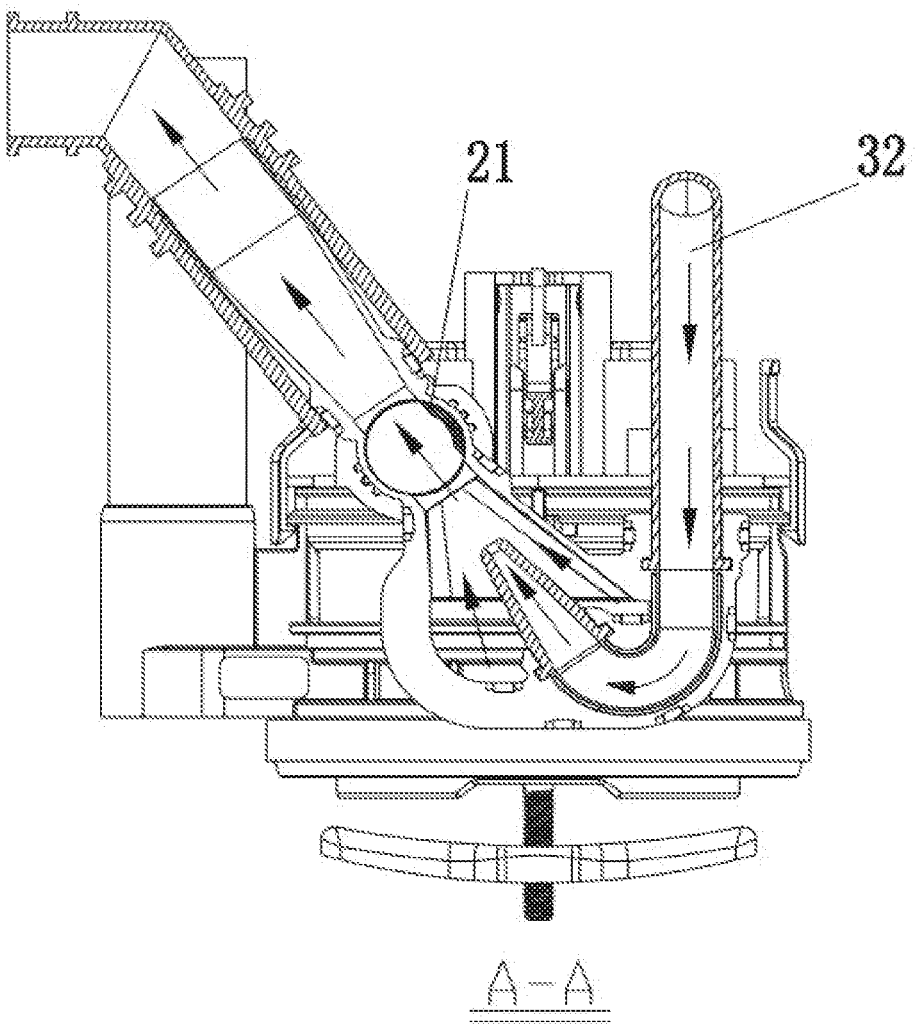
Figure 6:
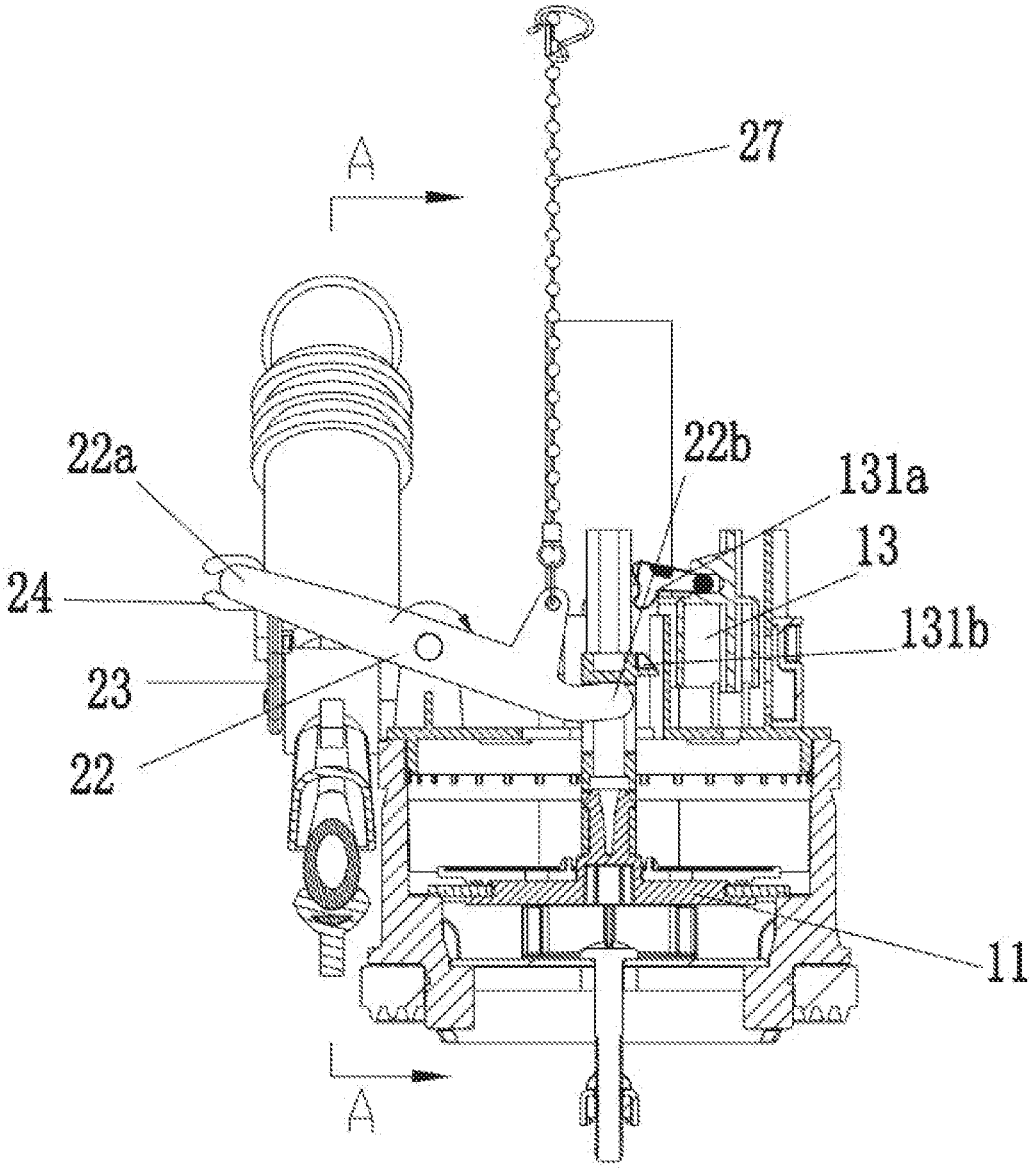
Figure 7:
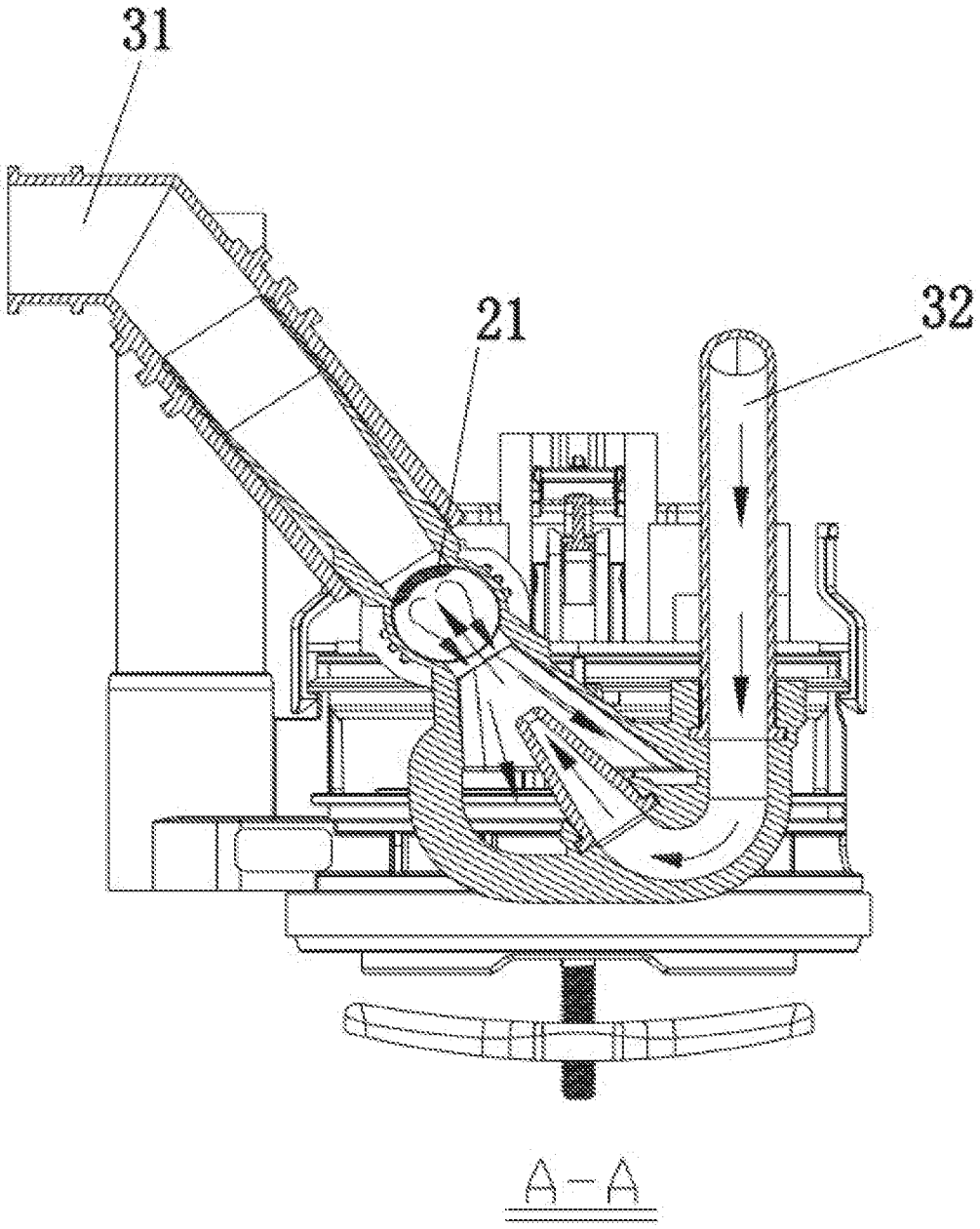
Figure 8:
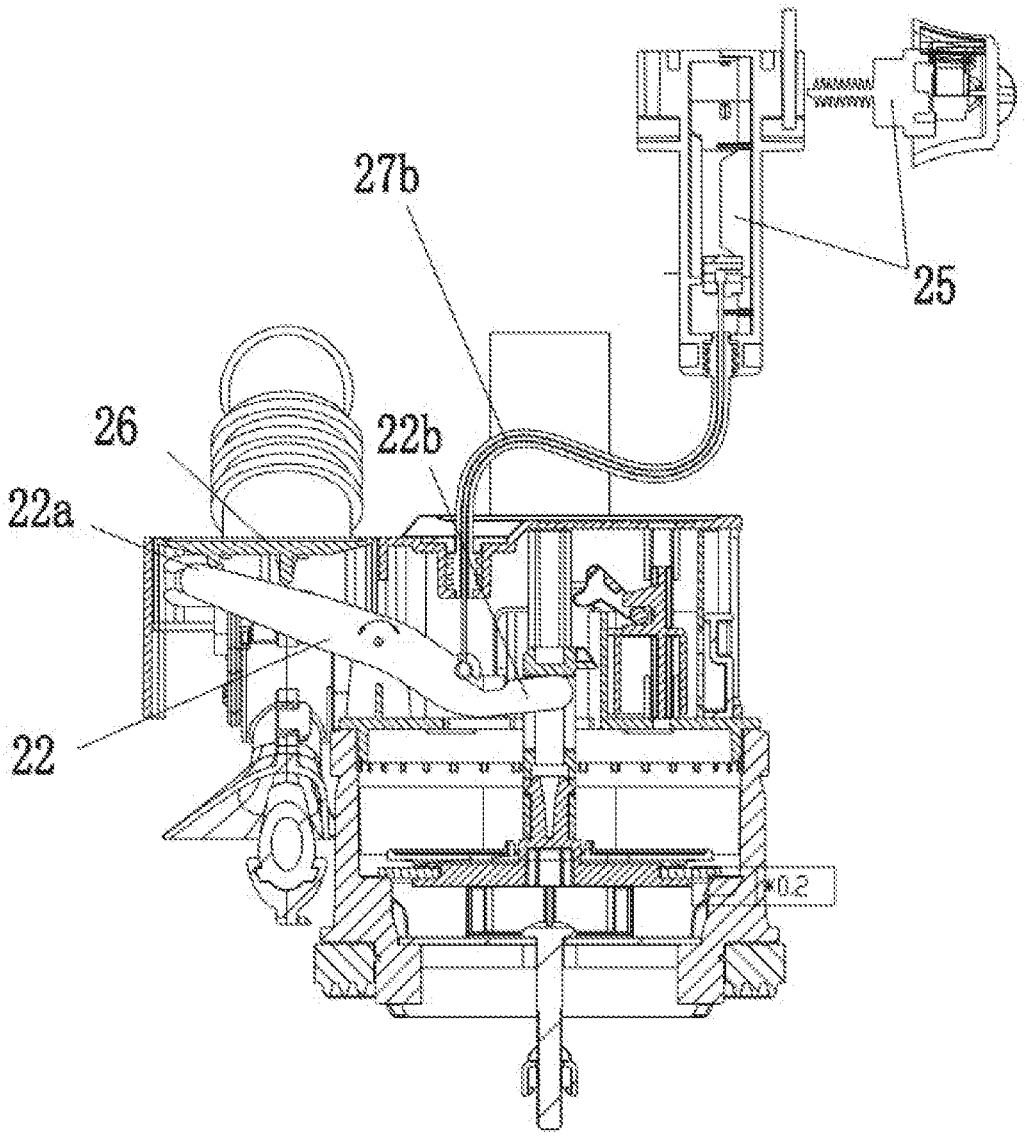
Figure 9:
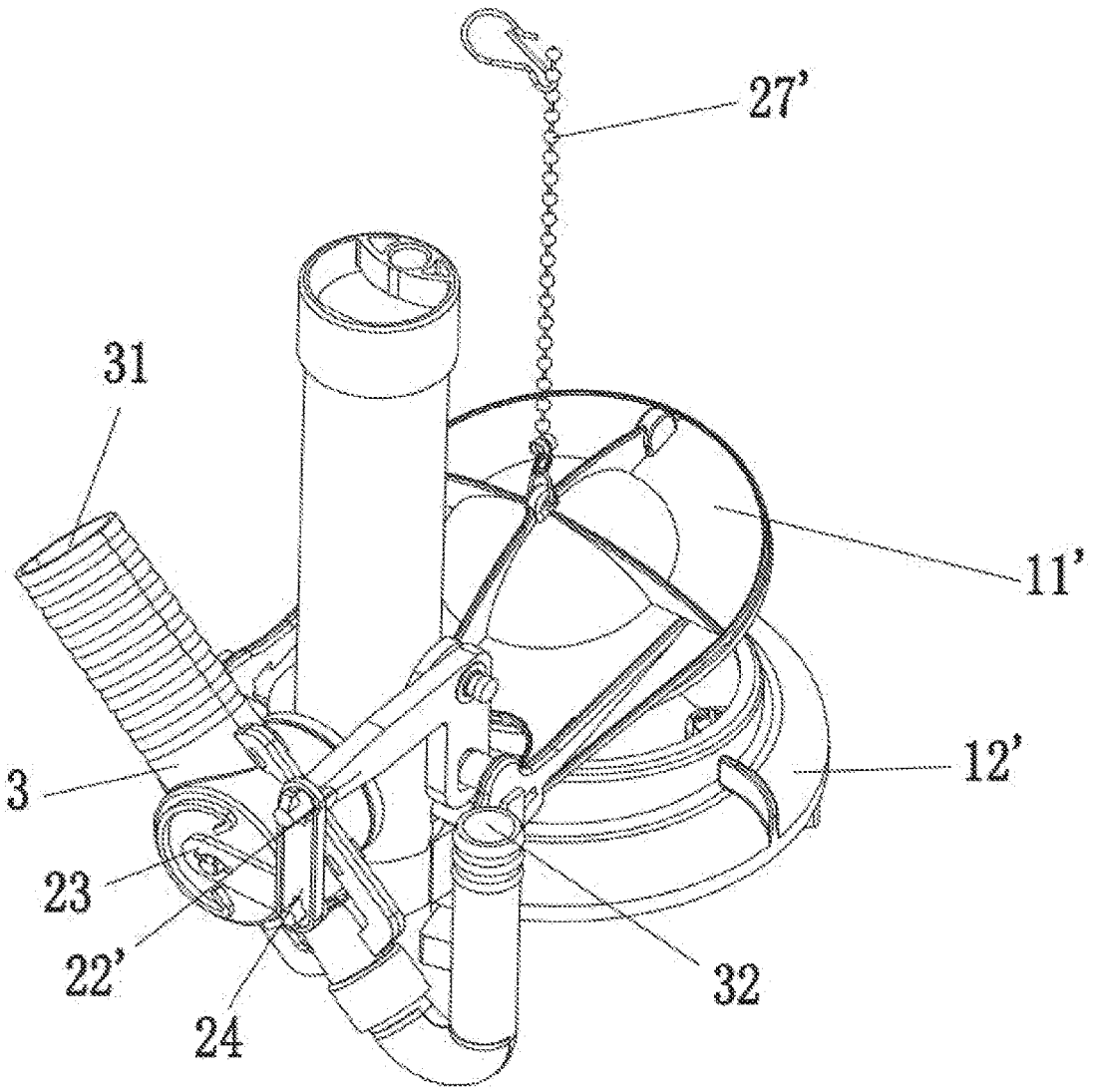
Figure 10:
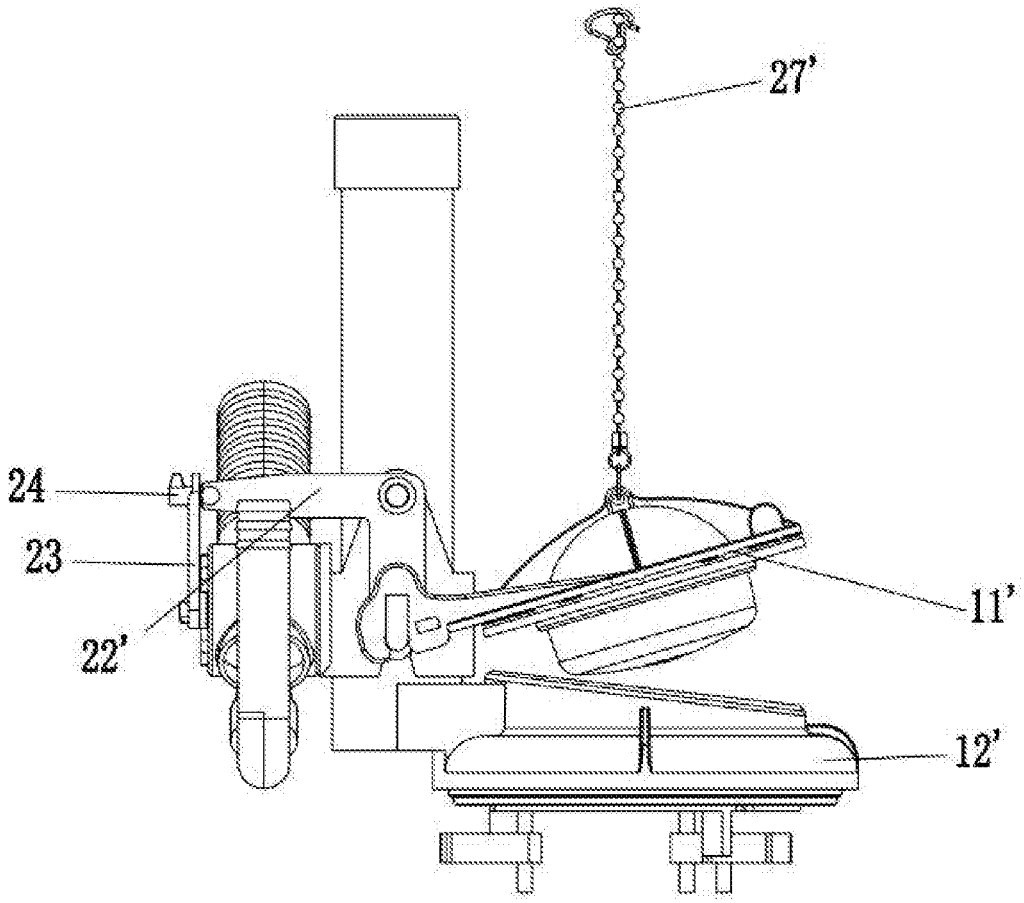
Figure 11:
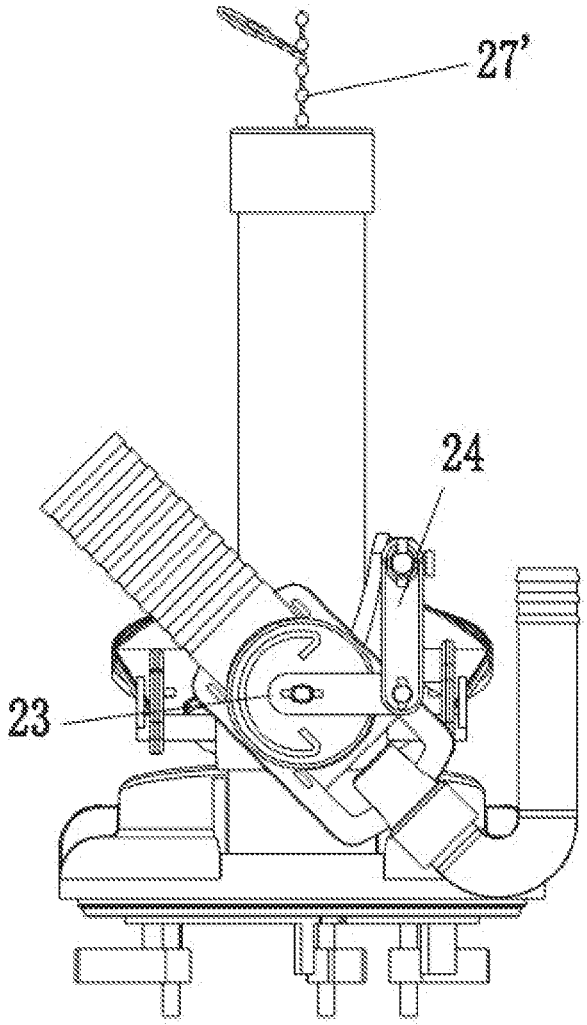
Figure 12:
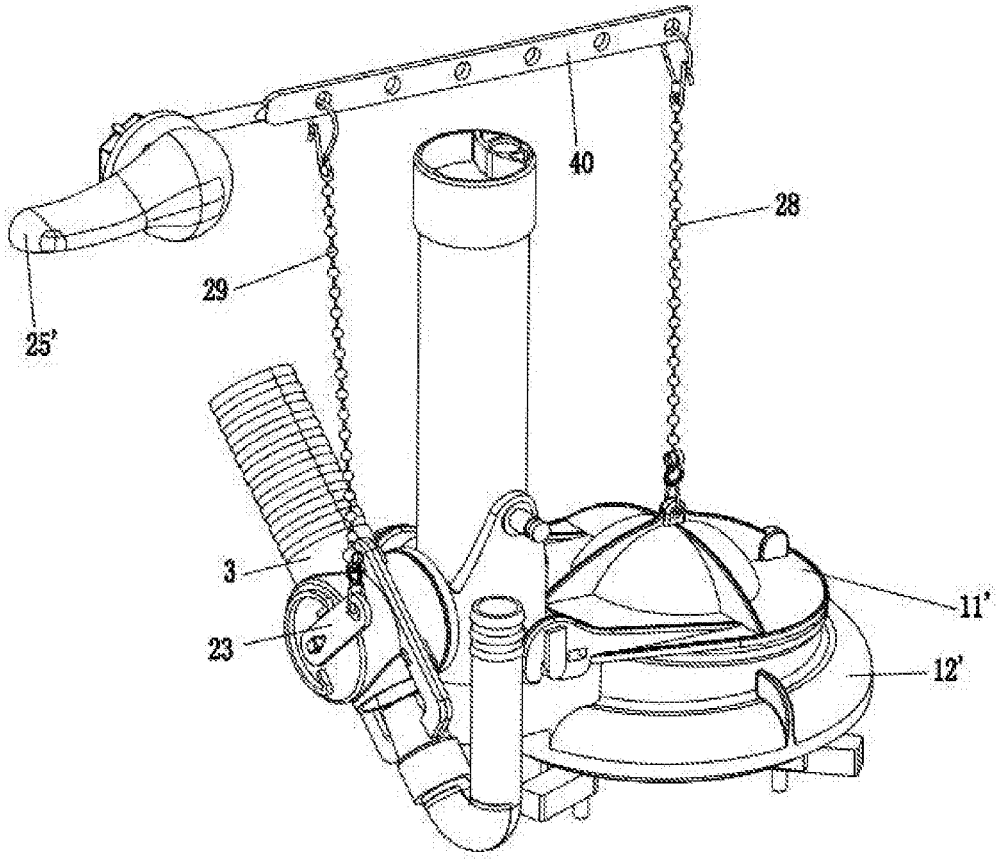

FIG. 1 is an overall view of a float-type drain valve for low-level water tank flushing;

FIG. 2 is a sectional view of the float-type drain valve for low-level water tank flushing;

FIG. 3 is a sectional view taken along a line A-A in FIG. 2;

FIG. 4 is a sectional view of the float-type drain valve for low-level water tank flushing in a draining state;

FIG. 5 is a sectional view taken along the line A-A in FIG. 4;

FIG. 6 is a sectional view of the float-type drain valve for low-level water tank flushing in a refilling state;

FIG. 7 is a sectional view taken along the line A-A in FIG. 6;

FIG. 8 is a sectional view of the float-type drain valve for low-level water tank flushing which is being driven by a button;

FIG. 9 is an overall view of a flapper-type drain valve for low-level water tank flushing;

FIG. 10 is a view of the flapper-type drain valve for low-level water tank flushing in a draining state;

FIG. 11 is a side view of the flapper-type drain valve for low-level water tank flushing;

FIG. 12 is an overall view of a third embodiment; and

Figure 13:
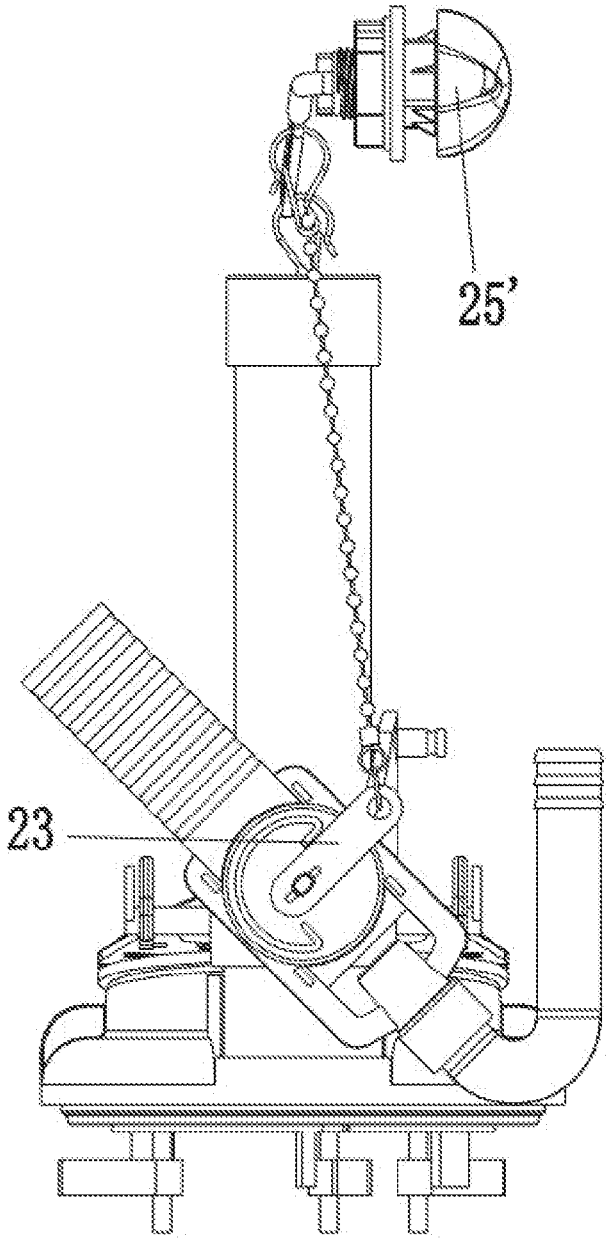

FIG. 13 is a side view of the third embodiment.

EMBODIMENTS OF THE APPLICATION

Detailed Description

As shown in FIG. 1, a drain valve for low-level water tank flushing according to the present application includes a drain valve body 1, a low-level washing ring flushing device 3 and a switch assembly 2. As shown in FIG. 2 or 9, the low-level washing ring flushing device 3 includes a water inlet 32 and a water outlet 31. The water inlet 32 is in communication with an outlet of a water inlet valve in a water tank. The switch assembly 2 includes a switch member and a switch sheet 21. The switch member is configured to control the movement of a sealing assembly 11, and open or close a drain port by controlling the movement of the sealing assembly 11. The switch sheet 21 is configured to switch between different communication states of the water inlet 32 and the water outlet 31. The switch member is connected to the switch sheet 21 by a connection member. When the switch member opens the sealing assembly 11 under the action of an external force, the switch sheet 21 is moved to allow a channel between the water inlet 32 and the water outlet 31 to switch from a small opening state to a large opening state simultaneously.

An opening portion in communication with the water tank is provided between the water inlet 32 and the water outlet 31. The switch member is connected to the switch sheet 21 by the connection member. Upon the action of the connection member, the switch member may open the sealing assembly 11 under the action of an external force for draining. A drop in the water level causes the water inlet valve in the water tank to be opened, meanwhile, the switch sheet 21 is moved to switch the channel between the water inlet 32 and the water outlet 31 from the small opening state to the large opening state. Then, water from the outlet of the water inlet valve flows into the water inlet 32, and a negative pressure is generated when the water passes through the opening portion provided between the water inlet 32 and the water outlet 31. The negative pressure allows the water in the water tank to be drawn towards the water outlet 31. The amount of water exiting the water outlet 31 is at least twice the amount of water entering the water inlet 32. When the draining ends, the sealing assembly 11 closes the drain port, and meanwhile the switch sheet 21 restores the channel into the small opening state.

The opening of the sealing assembly 11 causes the displacing of the switch sheet 21. The sealing assembly 11 is normally provided at the bottom of the water tank, and the low-level washing ring flushing device 3 is also normally provided at the bottom of the water tank in order to achieve a better flushing effect. Therefore, a synchronous opening of the sealing assembly 11 and the low-level washing ring flushing device 3 can be achieved without a very long connection member or being actuated by the float to open, thus the structure of the low-level washing ring flushing device 3 is compact.

The above-mentioned connection member for connecting the switch member and the switch sheet 21 is a lifting rod 22. A conversion device includes a crank 23 and a connection bar 24. The swing of the lifting rod 22 causes the connection bar 24 to rotate, and the connection bar 24 allows the crank 23 to rotate during rotation, so that the switch sheet 21 movably connected to the crank 23 is moved or restored. The lifting rod 22 moves the switch sheet 21 while lifting up the sealing assembly 11. The displacing of the switch sheet 21 is achieved by force conversion of a mechanical structure. The connection of the mechanical structures is stable and not apt to fail, which makes the flushing performance of the toilet stable.

First Embodiment

As shown in FIG. 1, the drain valve body is a float-type drain device.

One end, connected to the switch sheet 21 by the conversion device, of the lifting rod 22 is a switch sheet drive end 22*a*, and another end, connected to the sealing assembly 11, of the lifting rod 22 is a sealing assembly drive end 22*b*. The switch sheet drive end 22*a* is connected to the switch sheet 21 by the conversion device. The drain valve body 1 also includes a float 13. The float 13 and the sealing assembly 11 can be moved by each other. Preferably, the float 13 is provided with a hook 131*a* which interacts with a convex rib 131*b* on the sealing assembly 11. When the sealing assembly 11 is lifted up, the float 13 is lifted up simultaneously by the supporting of the sealing assembly 11; the float 13 slowly descends under the buoyancy of the water in the water tank during the drainage of the water tank, and the sealing assembly 11 remains in an open state due to the supporting of the float 13 before the water in the water tank is completely discharged.

The drain valve body further includes a housing 4, on which a fulcrum shaft 141 for fixing the lifting rod 22 is provided. The lifting rod 22 is movably connected to an upper-middle portion of the fulcrum shaft 141 and is swung by taking the fulcrum shaft 141 as a fulcrum point. At this time, the lifting rod 22 makes a lever-motion by taking the fulcrum shaft 141 as a fulcrum point. When being lifted up, the sealing assembly drive end 22*b* of the lifting rod 22 allows the sealing assembly 11 to move upwardly and open the drain port, and the switch sheet drive end 22*a* of the lifting rod moves downwardly and pushes the conversion device to allow the switch sheet 21 to be in a moved state. After being driven, the lifting rod 22 simultaneously allows the sealing assembly 11 to open and the switch sheet 21 to be moved and is movably secured within the housing 14, so that the drain valve body 1 and the low-level washing ring flushing device 3 can be actuated to move simultaneously and connected integrally, and form a drain valve for low-level water tank flushing which is compact in appearance and is convenient to be installed.

The conversion device may be a directional conversion rod for one or more forces. In the present application, the conversion device is illustrated with a preferred one of the embodiments. The preferred conversion device of the present application includes the crank 23 and the connection bar 24. The crank 23 is rotatably secured to the switch sheet 21.

Preferably, the crank 23 is a short flat bar. The crank 23 is rotatably secured to the connection bar 24. The connection bar 24 is movably connected to a projecting end of the lifting rod 22.

There are a variety of modes for actuating the lifting rod 22, which can be set depending on the practical requirements of the product.

One mode of actuating the lifting rod 22 is to provide a pulling rib at the sealing assembly drive end 22*b* or the switch sheet drive end 22*a* of the lifting rod. Preferably, as shown in FIG. 2, the pulling rib is arranged at the sealing assembly drive end 22*b* and a through hole is provided on the pulling rib for fixing a pulling member 27. As shown in FIG. 2, the pulling member may be a chain. In this case, a drive member connected to the chain 27*a* is located directly above the pulling rib. As shown in FIG. 8, the pulling member may also be a flexible pulling rope 27*b* in which a pulling metal wire is provided in a hose. In this case, a drive member 25 connected to the pulling rope may be provided on a side of the water tank. When the drive member is driven by an external force, a drive end of the lifting rod 22 is lifted up and the sealing assembly 11 is opened for draining.

Another mode of actuating the lifting rod 22 is to provide a drive button 26 above the switch sheet drive end 22*a* of the lifting rod. When the drive button 26 is pressed, the switch sheet drive end 22*a* is actuated downwardly so as to allow the switch sheet 21 to be moved, and meanwhile, the lifting rod 22 is pivoted by taking the fulcrum shaft as a fulcrum point to lift up the sealing assembly drive end 22*b*, so as to open the sealing assembly 11 for draining.

The switch device may include the above-described hose and chain or button, and one or all of them may be employed as practically required.

Preferably, in the case that the drain valve body is a float-type drain device, a vertical slide rod 142 is provided in the housing and a guide slide groove 1421 is provided on the vertical slide rod. The sealing assembly is slidably secured to the slide rod 142 via the guide slide groove 1421 and the sealing assembly is movable up and down within the slide groove 1421. The sealing assembly drive end 22*b* of the lifting rod 22 is rotatably connected to the sealing assembly 11. When being lifted up, the sealing assembly drive end 22*b* of the lifting rod 22 drives the sealing assembly 11 to move upwardly along the slide groove 1421.

The low-level washing ring flushing device can be connected to the float-type drain valve body in a variety of ways. The low-level washing ring flushing device can be integrally formed with the housing 14 of the float-type drain valve body. The low-level washing ring flushing device can also be fixed to the housing by detachable snap-fitting with a snap-fitting rib. With this connection mode, the low-level washing ring flushing device and the float-type drain valve body are formed into one piece, which has a compact structure and has functions of washing ring flushing and bottom injection of a ceramic toilet. A good flushing effect of the low-level water tank toilet is achieved by such a simple, compact and low-cost mechanical structure, which has a breakthrough practical significance.

In an initial state as shown in FIGS. 2 and 3, when the drain valve for low-level water tank flushing is in a static state with the water tank being filled with water, the sealing assembly 11 and the switch sheet 21 are in a closed state, and no water flows into the water inlet of the low-level washing ring flushing device.

In a draining state as shown in FIGS. 4 and 5, when water is drained through the drain valve for low-level water tank flushing, the lifting rod 22 is actuated and the sealing assembly drive end 22*b* is lifted upward, thus the sealing assembly 11 is opened to drain water.

Before the drainage ends, the sealing assembly 11 is delayed to close due to the supporting of the float 13. At the same time, the switch sheet drive end 22*a* is moved downwardly due to a leverage function, and the switch sheet 21 is moved to switch under the action of the conversion device, which allows the channel between the water inlet 32 and the water outlet 31 to be in the large opening state. As in the flow direction of water indicated by the arrow in FIG. 5, the water inlet valve in the water tank is opened due to the drop of the water level in the water tank, and tap water flows from the outlet of the water inlet valve to the water inlet. Since the switch sheet 21 is in the moved state, the water inlet pressure of the tap water forms a negative pressure at the opening portion. The water in the water tank is drawn by the negative pressure and flows through the port in the moved state of the switch sheet 21, and then is drawn to a toilet washing ring in a horizontal position being higher than the bottom of the water tank, so as to achieve the washing ring flushing.

In a refilling state of the water tank as shown in FIGS. 6 and 7, when the drainage of the drain valve for low-level water tank flushing ends, the water tank is empty and the float 13 descends due to loss of buoyancy, and due to loss of the supporting of the float 13, the sealing assembly 11 is restored to close the drain port of the valve seat. The sealing assembly 11 causes the sealing assembly drive end 22*b* of the lifting rod 22 to move downwardly when being restored downwardly, and the lifting rod 22 makes a lever swinging motion by taking the fulcrum shaft as a fulcrum point, so as to move the switch sheet drive end 22*a* upwardly and restore the switch sheet 21 under the action of the conversion device. At this time, water is continued to flow in by the water inlet valve and then flows out of the water inlet, and since the switch sheet 21 is restored, the inlet water cannot generate a negative pressure at the opening portion, thus the water tank is refilled with water via the water inlet of the water inlet valve. In the case that the water level in the water tank reaches to a pre-determined position, the water inlet valve is closed, and thus a cycle of draining-refilling is completed.

Second Embodiment

The drain valve body is a flapper-type drain valve.

As shown in FIGS. 9 to 11, the sealing assembly is a flapper device 11'. One end of the flapper device 11' is movably secured to the valve seat 12'. The flapper device 11' is pivoted upwardly upon a fixed fulcrum point when being pulled up. At this time, the lifting rod 22' engaged with the flapper device 11' at the fixed fulcrum point is actuated to open the switch sheet 21 under the action of the conversion device.

The flapper device 11' engages with the lifting rod 22' in a same direction to form a lever, and makes a lever motion upon the fixed fulcrum point on the valve seat. When the flapper device 11' is pulled up in a counterclockwise direction, the lifting rod is moved downwardly in a counterclockwise direction to drive the switch sheet 21 to be moved.

The flapper device 11' can also be engaged with the lifting rod 22' in a reverse direction. When the flapper device 11' is lifted up in the counterclockwise direction, an end, fixed to the valve seat, of the flapper device 11' pushes the lifting rod 22', so that the lifting rod 22' is moved downwardly in a clockwise direction and the switch sheet 21 is opened under the action of the conversion device.

The low-level washing ring flushing device 3 can be connected to the flapper-type drain device in a variety of ways. The low-level washing ring flushing device can be integrally formed with the valve seat 22' of the flapper-type drain device, and may also be fixed to the valve seat 12' by detachable snap-fitting with a snap-fitting rib. With this connection mode, the low-level washing ring flushing device 3 and the flapper-type drain device are formed into one body, which has a compact structure and has functions of washing ring flushing and bottom injection function in ceramic toilet flushing. A good flushing effect of the low-level water tank toilet is achieved by such a simple, compact and low-cost mechanical structure, which has a breakthrough practical significance.

In an initial state, when the drain valve for low-level water tank flushing is in a static state with the water tank being filled with water, the sealing assembly 11 and the switching member 21 are in a closed state, and no water flows into the water inlet of the low-level washing ring flushing device.

In a draining state, when water is drained through the drain valve for low-level water tank flushing, the flapper device 11' is lifted up for draining. Before the drainage ends, the flapper device is delayed to close due to the buoyancy. At the same time, due to the swinging or pushing of the flapper device, the lifting rod 22' causes the switch sheet 21 to be moved to switch under the action of the conversion device, which allows the channel between the water inlet 32 and the water outlet 31 to be in the large opening state. The water inlet valve in the water tank is opened due to the drop of the water level in the water tank, and tap water flows from the outlet of the water inlet valve to the water inlet. Since the switch sheet 21 is in the moved state, the water inlet pressure of the tap water generates a negative pressure at the opening portion. The water in the water tank is drawn by the negative pressure and flows through the port in the moved state of the switch sheet 21, and then is drawn to the toilet washing ring with a horizontal position higher than the bottom of the water tank, so as to achieve the washing ring flushing.

In a refilling state, when the drainage of the drain valve for low-level water tank flushing ends, the water in the water tank is drained, and the flapper device 11' descends due to loss of buoyancy and closes the drain port of the valve seat. When being restored downwardly, the flapper device 11' drives the lifting rod 22' to move downwardly or upwardly, and store the switch sheet 21 under the action of the conversion device. At this time, the water continues to flow in via the water inlet valve and then flows out of the water inlet, and since the switch sheet 21 is restored, the inlet water cannot generate a negative pressure at the opening portion, thus the water tank is refilled with water via the water inlet of the water inlet valve. When the water level in the water tank reaches to a pre-determined position, the water inlet valve is closed, and thus a cycle of draining-refilling is completed.

Third Embodiment

The drain valve body is a flapper-type drain valve.

As shown in FIGS. 12 and 13, the sealing assembly is a flapper device 11', and one end of the flapper device 11' is movably secured to the valve seat 12'. When the flapper device 11' is lifted upward, the flapper device 11' pivots upon a fixed fulcrum point. The lifting rod is a cross bar 40 connected to a driving wrench 25'. A chain for pulling the flapper device 11' is hang on the cross bar 40. A chain 28 is configured to pull the flapper device 11' and is arranged at an end, away from the wrench 25', of the cross bar 40. A chain 29 is configured to pull the crank connected to the switch sheet 21 and is arranged at an end, close to the wrench 25', of the cross bar. When the wrench 25' is turned, the cross bar 40 is lifted upwardly, such that the flapper device 11' opens the drain port and the switch sheet 21 is moved to allow the channel between the water inlet and the water outlet to switch from the small opening state to the large opening state simultaneously.

The above-described embodiments are merely intended to illustrate the present application and are not intended to be limiting of the present application. All the variations and modifications of the above-described embodiments will fall within the scope of the claims of the present application as long as they are based on the technical spirit of the present application.

INDUSTRIAL APPLICABILITY

According to the present application, the switch sheet of the low-level washing ring flushing device and the switch member of the drain valve body are simultaneously actuated, and when the drain valve body is driven and opened, the switch sheet of the low-level washing ring flushing device is synchronously driven under the action of the conversion device to be moved, so as to allow the channel to switch into the large opening state. The conversion device for driving the opening is a mechanical structure, thus, the product has a stable performance and a long service life.

The invention claimed is:

1. A drain valve for low-level water tank flushing, comprising a drain valve body, a low-level washing ring flushing device and a switch assembly, wherein, the drain valve body comprises a sealing assembly and a valve seat, the sealing assembly is arranged on the valve seat and configured to open or close a drain port of the valve seat;

the low-level washing ring flushing device comprises a water inlet and a water outlet, the water inlet is in communication with an outlet of a water inlet valve in a water tank;

the switch assembly comprises a switch member and a switch sheet, and the switch member controls the movement of the sealing assembly and opens or closes the drain port by controlling the movement of the sealing assembly, and the switch sheet is configured to switch between different communication states of the water inlet and the water outlet;

wherein the switch member is connected to the switch sheet by a connection member, and in the case that the switch member opens the sealing assembly under the action of an external force, the switch sheet is moved to allow a channel between the water inlet and the water outlet to switch from a small opening state to a large opening state.

2. The drain valve for low-level water tank flushing according to claim 1, wherein the connection member is a lifting rod which is connected to the switch sheet by a conversion device.

3. The drain valve for low-level water tank flushing according to claim 2, wherein the conversion device comprises a crank and a connection bar, the lifting rod swings to drive the connection bar to rotate, and the connection bar drives the crank to rotate during rotation, which further allows the switch sheet movably connected to the crank to be moved or restored.

4. The drain valve for low-level water tank flushing according to claim 3, wherein the drain valve body is a float-type drain device, the lifting rod is rotatably connected to the sealing assembly, and one end, close to the sealing assembly, of the lifting rod is a sealing assembly drive end, and another end, close to the switch sheet, of the lifting rod is a switch sheet drive end.

5. The drain valve for low-level water tank flushing according to claim 4, wherein the drain valve body further comprises a housing, and a fulcrum shaft for fixing the lifting rod is provided on the housing, the lifting rod is movably connected to an upper-middle portion of the fulcrum shaft and is swung by taking the fulcrum shaft as a fulcrum point.

6. The drain valve for low-level water tank flushing according to claim 5, wherein the switch assembly comprises a pulling member which is connected to the sealing assembly drive end of the lifting rod, and in the case that the lifting rod is pulled by an external force via the pulling member, the sealing assembly is opened and the sealing assembly drive end of the lifting rod is lifted up to allow the switch sheet drive end of the lifting rod to drive the connection bar to rotate and further drive the crank to move the switch sheet.

7. The drain valve for low-level water tank flushing according to claim 5, wherein the switch assembly comprises a button, and the switch sheet drive end of the lifting rod is located below the button, the button is driven by an external force to drive the sealing assembly drive end of the lifting rod to move upwardly and then open the sealing assembly, and drive the switch sheet drive end of the lifting rod to move downwardly and cause the switch sheet to be moved.

8. The drain valve for low-level water tank flushing according to claim 6, wherein a vertical slide rod is provided in the housing, the vertical slide rod is provided with a guide slide groove, and the sealing assembly is slidably secured to the slide rod via the guide slide groove.

9. The drain valve for low-level water tank flushing according to claim 3, wherein the drain valve body is a flapper-type drain device, the sealing assembly is a flapper device, one end of the flapper device is movably secured to the valve seat and is pivoted upon a fixed fulcrum point, the lifting rod is engaged with the flapper device at the fixed fulcrum point, the flapper device opens the drain port when being pulled up, meanwhile, the flapper device is rotated so that the lifting rod is driven and the switch sheet is moved under the action of the conversion device.

10. The drain valve for low-level water tank flushing according to claim 9, wherein the flapper device is engaged with the lifting rod in a same direction to form a lever, which makes a lever-motion upon the fixed fulcrum point on the valve seat, and when the flapper device is pulled up in a counterclockwise direction, the lifting rod is moved downwardly in the counterclockwise direction to move the switch sheet.

11. The drain valve for low-level water tank flushing according to claim 9, wherein the flapper device is engaged with the lifting rod in a reverse direction, and when the flapper device is lifted up in the counterclockwise direction, the one end of the flapper device secured to the valve seat pushes the lifting rod and drive the lifting rod to move upwardly in a clockwise direction to move the switch sheet.

12. The drain valve for low-level water tank flushing according to claim 3, wherein the drain valve body is a flapper-type drain valve device, the sealing assembly is a flapper device, the lifting rod is a cross bar connected to a wrench, a chain configured to pull the flapper device and the switch sheet is hung on the cross bar, and in the case that the wrench is turned, the cross bar is lifted upwardly to allow the flapper device to open the drain port, and the switch sheet is moved to allow the channel between the water inlet and the water outlet to switch from the small opening state to the large opening state simultaneously.

13. The drain valve for low-level water tank flushing according to claim 1, wherein the low-level washing ring flushing device is integrally formed with the drain valve body, or is detachably secured to the drain valve body by a snap-fitting rib.

14. The drain valve for low-level water tank flushing according to claim 7, wherein a vertical slide rod is provided in the housing, the vertical slide rod is provided with a guide slide groove, and the sealing assembly is slidably secured to the slide rod via the guide slide groove.

15. The drain valve for low-level water tank flushing according to claim 2, wherein the low-level washing ring flushing device is integrally formed with the drain valve body, or is detachably secured to the drain valve body by a snap-fitting rib.

16. The drain valve for low-level water tank flushing according to claim 3, wherein the low-level washing ring flushing device is integrally formed with the drain valve body, or is detachably secured to the drain valve body by a snap-fitting rib.

17. The drain valve for low-level water tank flushing according to claim 4, wherein the low-level washing ring flushing device is integrally formed with the drain valve body, or is detachably secured to the drain valve body by a snap-fitting rib.

18. The drain valve for low-level water tank flushing according to claim 5, wherein the low-level washing ring flushing device is integrally formed with the drain valve body, or is detachably secured to the drain valve body by a snap-fitting rib.

19. The drain valve for low-level water tank flushing according to claim 6, wherein the low-level washing ring flushing device is integrally formed with the drain valve body, or is detachably secured to the drain valve body by a snap-fitting rib.

20. The drain valve for low-level water tank flushing according to claim 7, wherein the low-level washing ring flushing device is integrally formed with the drain valve body, or is detachably secured to the drain valve body by a snap-fitting rib.

* * * * *